US008336738B2

(12) United States Patent
Bouix et al.

(10) Patent No.: US 8,336,738 B2
(45) Date of Patent: Dec. 25, 2012

(54) REUSABLE PUMP DISPENSER FOR HEATED PERSONAL CARE COMPOSITIONS

(75) Inventors: Herve F. Bouix, New York, NY (US); Christophe Jacob, Rouen (FR)

(73) Assignee: ELC Management LLC, New York, NY (US)

( * ) Notice: Subject to any disclaimer, the term of this patent is extended or adjusted under 35 U.S.C. 154(b) by 295 days.

(21) Appl. No.: 12/948,840

(22) Filed: Nov. 18, 2010

(65) Prior Publication Data

US 2012/0125950 A1 May 24, 2012

(51) Int. Cl.
*B67D 7/80* (2010.01)

(52) U.S. Cl. ..... 222/146.5; 219/628

(58) Field of Classification Search ..... 222/146.5, 222/146.1–146.4, 131, 173, 621, 628, 183; 219/680–630; 392/341
See application file for complete search history.

(56) References Cited

U.S. PATENT DOCUMENTS

| | | | | |
|---|---|---|---|---|
| 2,488,591 | A | 11/1949 | Fevas | |
| 3,518,410 | A * | 6/1970 | Dillarstone | 392/477 |
| 4,067,480 | A * | 1/1978 | Gasser | 222/146.3 |
| 4,274,588 | A * | 6/1981 | Schwob | 239/138 |
| 4,291,685 | A | 9/1981 | Taelman | |
| 4,329,567 | A | 5/1982 | Kunz et al. | |
| 4,465,073 | A | 8/1984 | Schwob | |
| 4,538,630 | A | 9/1985 | Henderson | |
| 4,733,784 | A | 3/1988 | Bennett | |
| 4,889,440 | A | 12/1989 | Shano | |
| 5,096,319 | A | 3/1992 | Gueret | |
| 5,395,175 | A | 3/1995 | Bontoux et al. | |
| 5,513,771 | A * | 5/1996 | Cote | 221/75 |
| 5,556,468 | A | 9/1996 | Legrain et al. | |
| 5,775,344 | A | 7/1998 | Clay | |
| 5,851,079 | A | 12/1998 | Horstman et al. | |
| 5,853,010 | A | 12/1998 | Suh | |
| 5,911,226 | A | 6/1999 | Vecchiola et al. | |
| 6,009,884 | A | 1/2000 | Suh | |
| 6,454,127 | B1 | 9/2002 | Suomela et al. | |
| 6,508,603 | B1 | 1/2003 | Vasas | |
| 6,911,010 | B2 * | 6/2005 | Dirks et al. | 601/15 |
| 7,083,347 | B2 | 8/2006 | Marcotte et al. | |
| 7,090,420 | B2 | 8/2006 | De La Poterie et al. | |
| 7,108,438 | B2 | 9/2006 | Fontaine | |
| 7,227,108 | B2 * | 6/2007 | Clothier et al. | 219/618 |

(Continued)

FOREIGN PATENT DOCUMENTS

| | | |
|---|---|---|
| DE | 19839940 | 3/2000 |
| EP | 1563760 | 8/2005 |

(Continued)

OTHER PUBLICATIONS

PCT International Search Report; International Application No. PCT/US2011/066229; Completion Date: Aug. 28, 2012; Date of Mailing: Aug. 29, 2012.

(Continued)

*Primary Examiner* — Lien Ngo
(74) *Attorney, Agent, or Firm* — Peter Giancana

(57) ABSTRACT

A handheld, reusable product dispenser that heats a portion of flowable product as it is being dispensed from a reservoir. The reusable heating dispenser that is able to heat at least 50 μL of a flowable product, from an ambient temperature to a product application temperature, immediately prior to dispensing. By heating the product, some characteristic of the product may be enhanced or improved. The reservoir is removable from the reusable housing. Preferably, the heating circuit is battery powered.

31 Claims, 10 Drawing Sheets

U.S. PATENT DOCUMENTS

| | | | |
|---|---|---|---|
| 7,322,366 | B2 | 1/2008 | Cho |
| 7,448,814 | B2 | 11/2008 | Bouix et al. |
| 7,465,114 | B2 | 12/2008 | Kress et al. |
| 7,661,562 | B2 | 2/2010 | Tyrrell et al. |
| 7,669,605 | B2 | 3/2010 | Cho |
| 7,753,609 | B2 | 7/2010 | Bouix et al. |
| 2004/0096258 | A1 | 5/2004 | Kim |
| 2004/0247367 | A1 | 12/2004 | Fontaine |
| 2005/0013838 | A1 | 1/2005 | De La Poterie |
| 2005/0031656 | A1 | 2/2005 | Pays et al. |
| 2005/0244209 | A1 | 11/2005 | Gueret |
| 2005/0258172 | A1 | 11/2005 | Gueret |
| 2006/0032512 | A1 | 2/2006 | Kress et al. |
| 2006/0246118 | A1 | 11/2006 | Gueret |
| 2006/0251686 | A1 | 11/2006 | Gueret |
| 2007/0206986 | A1 | 9/2007 | Gueret |
| 2008/0273911 | A1 | 11/2008 | Gueret |
| 2009/0020133 | A1 | 1/2009 | Gueret |
| 2010/0054841 | A1 | 3/2010 | Cho |
| 2010/0086507 | A1 | 4/2010 | Gueret |

FOREIGN PATENT DOCUMENTS

| | | |
|---|---|---|
| FR | 2891394 | 3/2007 |
| GB | 2174896 | 11/1986 |
| WO | 2007/114551 | 10/2007 |

OTHER PUBLICATIONS

PCT Written Opinion of the International Searching Authority; International Application No. PCT/US2011/066229; Completion Date: Aug. 28, 2012; Mailing Date: Aug. 29, 2012.

Mince, Thermofoil Heaters (on-line), 2005 (Retrieved on Mar. 22, 2006). Retrieved from the Internet: URL http://www.minco.com/products/heaters.aspx.

International Search Report mailed Mar. 8, 2008, of PCT/US07/69759.

Written Opinion of the ISA dated Mar. 8, 2008, of PCT/US07/69759.

U.S. Appl. No. 12/732,835. "Heated Mascara Applicator and Suitable Compositions." Filed Mar. 26, 2010.

Related Application: Bouix and Jacob, "Cosmetic Applicators Containing Heating Elements," U.S. Appl. No. 12/730,789, filed Mar. 24, 2010.

Related Application: Bouix and Jacob, "Cosmetic Applicators Containing Heating Elements," U.S. Appl. No. 11/422,729, filed Jun. 7, 2006.

Related Application: Bouix, et al., "A System for Sampling A Heated Product," U.S. Appl. No. 12/980,526, filed Dec. 29, 2010.

* cited by examiner

REUSABLE PUMP DISPENSER FOR HEATED PERSONAL CARE COMPOSITIONS

FIELD OF THE INVENTION

The present invention pertains to product dispensers that heat a portion of fluid as it is being dispensed from a reservoir. More specifically, the present invention is concerned with handheld, reusable pump dispensers that heat a personal care product as it is being dispensed.

BACKGROUND OF THE INVENTION

Product dispensers that heat a product prior to or at the time of dispensing are known. Some heating dispensers heat more than is dispensed, which exposes product in the container to temperature cycling. However, many cosmetic and dermatologic products are unstable when subjected to temperature cycling. Temperature cycling can cause degradation or other unwanted alteration of the product. Degradation includes, for example, a breakdown in viscosity, changes in color and odor. Another unwanted alteration might be that an inactivated ingredient in a portion of product becomes activated, even though it has not been dispensed. For products that will be changed structurally or chemically by the application of too much heat or from being too often heated, these prior art devices are wholly unsuitable. Therefore, prior art devices that heat even a portion of the reservoir, or that heat more product than will be used, are unsuitable for many cosmetic applications. Another disadvantage of devices that heat the reservoir, or that heat more product than will be used, is the power consumed. Far more power must be consumed by these devices because they aim to raise the temperature of a greater mass of product than the present invention. This is costly and inconvenient if batteries need to be replaced often. Some heating dispensers are inconsistent in the amount of time that a portion of product is heated. This happens, for example, when the heating time is variably controlled by a user dispensing the product. U.S. Pat. No. 7,448,814 discloses a device having this drawback. A portion of the reservoir is flexible, and when depressed by a user an amount of heated product is dispensed. But the amount of product dispensed in variable because it depends how hard the user depresses the flexible portion. Some heating dispensers require an external device for operation, like a separate power supply or separate heating component. Some heating dispensers require 100 volts of electricity or more. The electronics of these devices may include external power cords. External power cords tend to deteriorate and be unwieldy; the plug-in power cord does not offer the mobility and safety of batteries, and the voltage used is much higher than that of batteries. Some heating dispensers are only useful for relatively viscous products, because the device would leak if the viscosity of the heated product became too low. Likewise, some heating dispensers are not useful for storing a flowable product when not in use, or they require extra componentry. Some heating dispensers are aesthetically or ergonomically unsuitable for the personal care marketplace. Many heating dispensers are not handheld, meaning that they can be held in the air and product dispensed with one hand. Many heating dispensers would require too long to heat a product compared to what is commercially acceptable in the personal care marketplace. Many heating dispensers are not in the form of a lotion pump or liquid spray pump, so familiar to the personal care and fragrance consumer.

All of this is in contrast to the present invention, wherein: the product remaining in the dispenser is not substantially heated and remains in good condition for future use; relatively little power is consumed; the amount of time that a portion of product is heated is consistent from dose to dose; no external device for operation is required; only battery power is required; there are no external power cords; the device is handheld and completely portable, usable anywhere; low viscosity fluids will not leak; the present heating dispenser is aesthetically or ergonomically suitable for the personal care marketplace, because the form and functioning of the device a completely familiar to the consumer; a dose of product can be heated in commercially acceptable amount of time.

Furthermore, it is known for heated cosmetic and personal care dispensers to utilize conventional, flexible metallic wiring and contacts for conducting electricity from a power source to a switch, then to a heating element and possibly to one or more light indicators and temperature controls, before returning to the power source. If more than one independent circuit is required, then the number of wires and electrical connections increases proportionately. In contrast, heating dispensers according to embodiments of the present invention do not use metal wire conductors or use substantially fewer, do not have the space constraints associated with using wire circuitry, substantially reduce the labor required to assemble the dispenser, have more reliable electrical connections and sophisticated electrical options, and reduced circuit length.

OBJECTIVES

Various embodiments of the invention meet one, some or all of the following objectives. The term "objective" does not, by itself, make a feature essential.

One object of the present invention is to provide a handheld, reusable heating dispenser that is able to heat at least 50 μL, preferably at least 100 μL, more preferably at least 250 μL, most preferably at least 500 μL of a flowable product, from an ambient temperature to a product application temperature, in 60 seconds or less, preferably 30 seconds or less, more preferably 15 seconds or less, and most preferably 5 seconds or less, immediately prior to dispensing.

Another object is to provide a personal care composition in combination with a heating dispenser that is capable of heating the product so that some characteristic of the product is enhanced or improved.

SUMMARY OF THE INVENTION

Figure 1A:
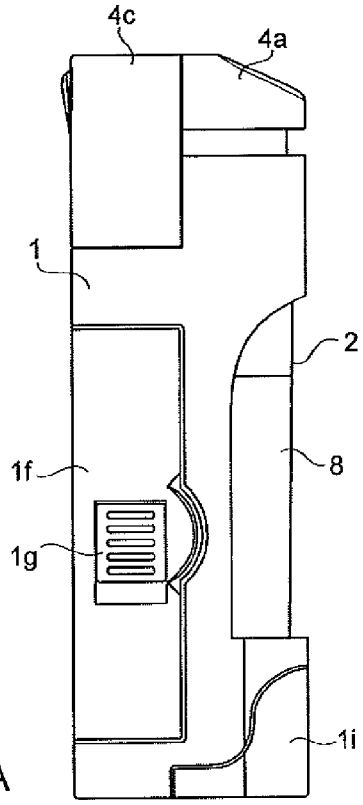
FIG. 1*a* is an elevation view of a handheld, reusable heating dispenser for personal care products.

This summary is provided merely as an introduction and does not, by itself, limit the appended claims. According to one aspect, the present invention is a handheld, reusable heating dispenser comprising a reservoir of flowable product, a pump mechanism, a heating circuit, and a reusable housing that holds the reservoir and heating circuit in a specific relationship. The reservoir is removable from the reusable housing. Generally, the heating circuit comprises a switch, a power source, and a heat generating portion. Preferably, the heating circuit is battery powered, and the one or more batteries are removable and/or rechargeable. Preferably, all or part of the electronic circuit is removable for disposal of the dispenser. Following, are described particular embodiments of a Reusable Pump Dispenser For Heated Personal Care Compositions. This description should not be construed as limiting the scope of this invention, except as set forth in the claims.

DETAILED DESCRIPTION

The present application is concerned with reusable heating dispensers for flowable products. A main focus of the present invention is personal care compositions. Although some of the principles described herein are more broadly applicable, the principles will be described in relation to flowable personal care compositions.

DEFINITIONS

"Product application temperature" means a temperature of the product that is greater than ambient temperature, at which some characteristic of the product is enhanced or improved. For example, ambient temperature may be taken to be 20° to 25° C., while product application temperature may be 30° C. or greater, or 40° C. or greater, or 50° C. or greater, and so on, as the situation dictates. The improved characteristic may relate to application of the product to the skin or hair, or it may relate to the performance or shelf life of the product. Furthermore, the improved characteristic may relate to a consumer's experience or expectation of the product. For example, the characteristic improvement may be a pre-defined reduction in viscosity. Or, for example, it may be activation of an active ingredient above a threshold temperature. Or, for example, the improved characteristic may be longer shelf life due to a reduction in harmful microbes in the product. Or the improved characteristic may be a feeling of warmth, experienced by the consumer.

"Handheld dispenser" means a dispenser that is intended to be held in one or, at most two hands, and raised in the air as the dispenser is performing one or more main activities. Main activities include loading product into the dispenser and delivering product to an application surface. Thus, "handheld" means more than just being able to grasp an object. For example, a "space heater" does not meet this definition of handheld.

Throughout the specification "comprise" means that an element or group of elements is not automatically limited to those elements specifically recited, and may or may not include additional elements.

Throughout the specification, "electrical contact" means that, if a potential difference is provided between electronic elements, then an electric current is able to flow between those elements, whether there is direct physical contact between the elements or whether one or more other electronic elements intervene.

Various features of some of the embodiments will now be described. Certain described features may be used separately or in combination with other described or implied features. Some of the embodiments may use only one or more described features.

Introduction

Figure 1B:
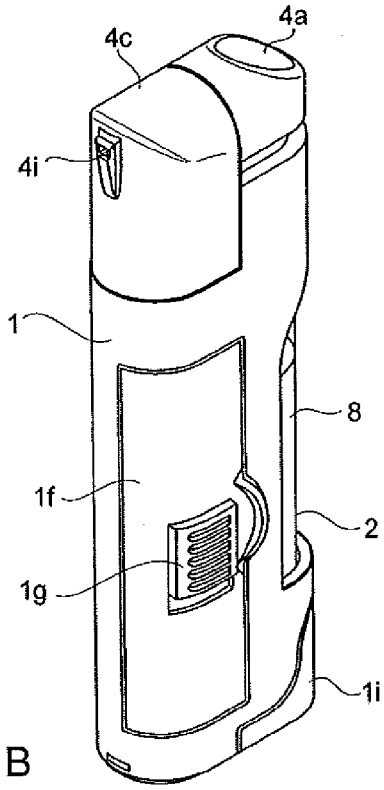
FIG. 1*b* is a perspective view of the reusable heating dispenser of FIG. 1*a*.
Figure 1C:
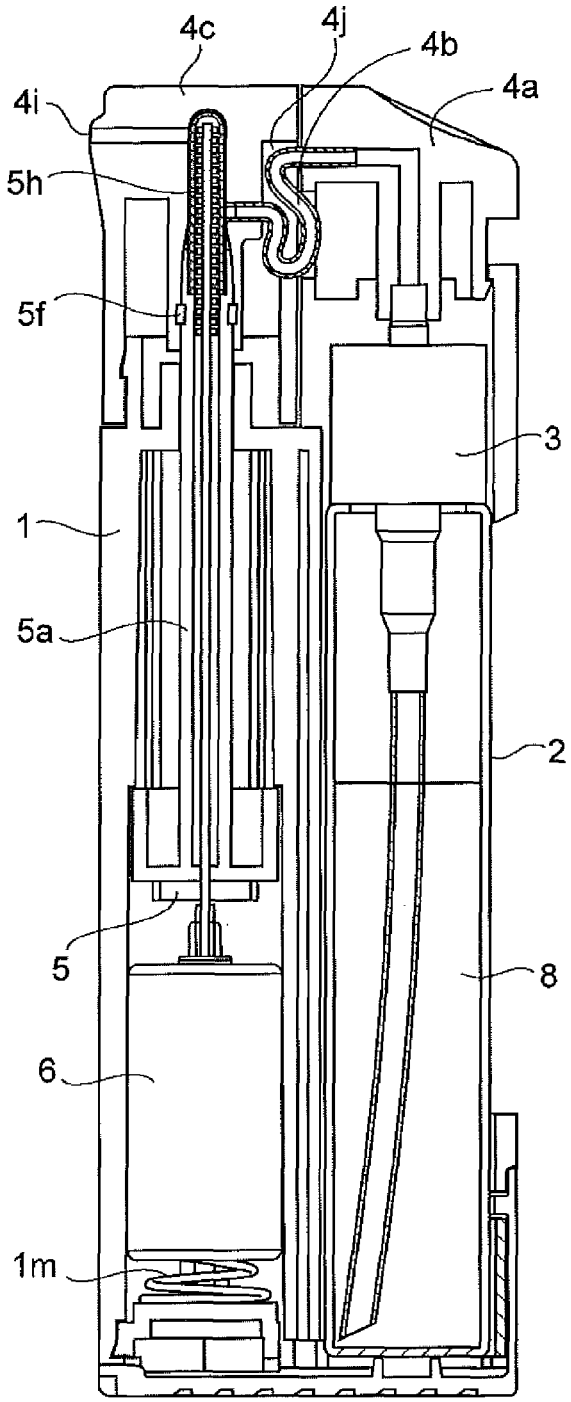
FIG. 1*c* is a cross section of the handheld, reusable heating dispenser of FIG. 1*a*.

One embodiment of a handheld, reusable heating dispenser for personal care products, is shown in FIGS. 1*a*, 1*b* and 1*c*. In these figures, the dispenser comprises a reusable housing (1), a dispensing head (4*c*), a reservoir or container (2), a mechanical fluid pump (3), an actuator for the pump (4*a*), a printed circuit board (5*a*), a heat generating portion (5*h*), a circuit board housing (5*b*), a power source (6), a sliding switch (1*g*), and a flowable product (8) in the reservoir. Also provided is path for the flowable product. The path extends from the reservoir, through the mechanical pump, through the actuator, across the heating chamber, which is a space surrounding the heating generating portion inside the dispensing head, and out an orifice (4*i*) of the dispensing head.

The Reusable Housing

Figure 3A:
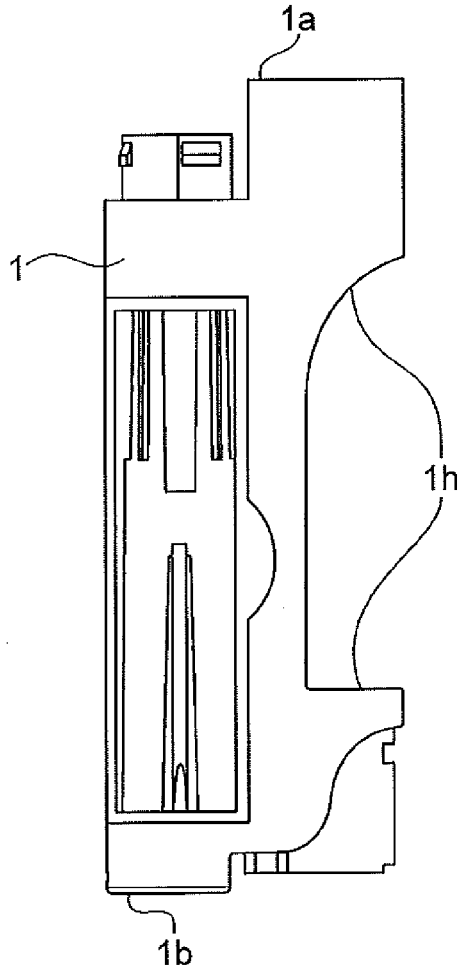
FIG. 3*a* is an elevation view of a reusable housing.
Figure 3B:
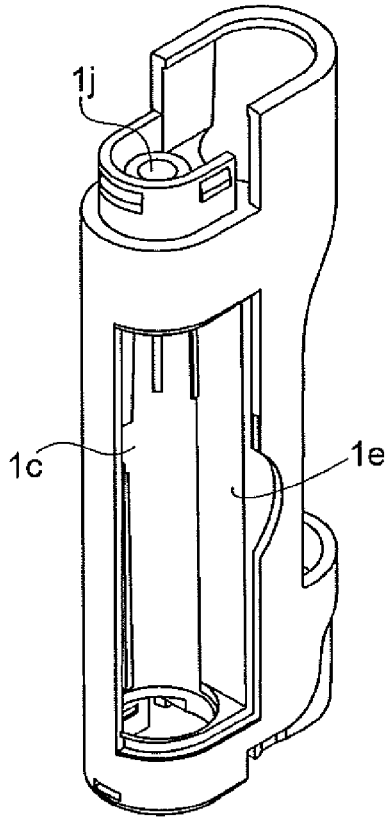
FIGS. 3*b* and 3*c* are perspective views of the reusable housing of FIG. 3*a*.
Figure 3C:
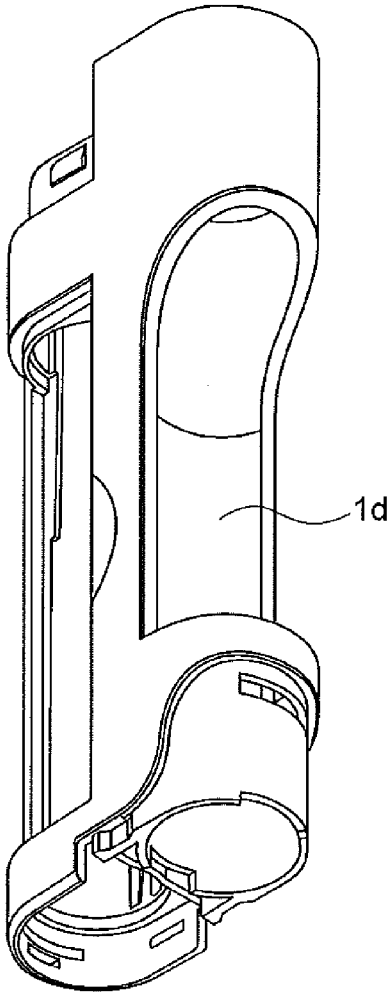

The heating dispenser includes a reusable housing (1) fashioned as an elongated structure comprising a top end (1*a*) and a bottom end (1*b*) (see FIGS. 3*a*, 3*b*, 3*c*). The reusable housing is, generally, that part of the dispenser that is grasped by one hand of a user. The reusable housing is partially hollow, and shown as a quasi-cylindrical structure, but the shape may vary. The reusable housing has an interior space that is divided (for example, laterally) into first and second sections (1*c*, 1*d*). First section (1*c*) is sufficiently large to accommodate an electrical heating circuit, which may include a current source (6), such as one or more batteries, one or more metallic leads, a printed circuit board (5*a*), a housing for the printed circuit board (5*b*), and any other support structure. Mounted in the reusable housing, near the bottom of the first section, a metal strip (1*k*) and metal coil (1*m*) form part of an electric circuit (see FIG. 5*b*). The second section (1*d*) accommodates a reservoir (2) of product (8), and part of a dispensing system. First and second sections may or may not be separated from each other by an interior wall (1*e*), or part thereof. Thus, the reusable housing provides two, well defined, elongated spaces, side-by-side, one for the bulk of the electronics and one for the reservoir and dispensing system.

A battery door (1*f*) is shown in the side of the reusable housing (1). When the battery door head is removed from the reusable housing, access is gained to the first section (1*c*). Through this door, a battery can be put into or removed from the electrical heating circuit. Optionally, it may also be possible to install or remove the heating circuit subassembly through this door.

Figure 2:
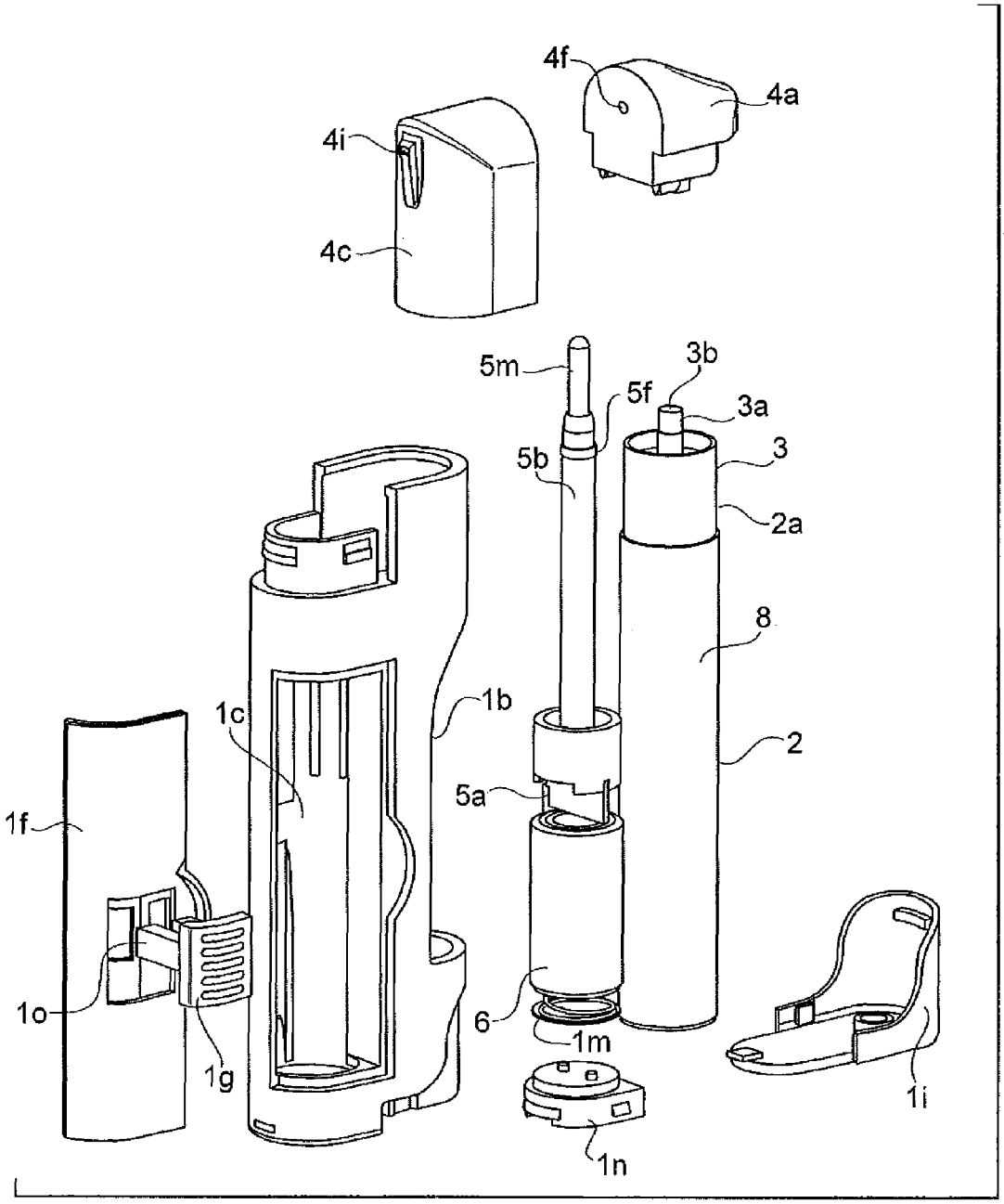
FIG. 2 is an exploded, perspective view of a reusable heating dispenser for personal care products.

A sliding switch (1*g*) for the electrical heating circuit is shown in FIGS. 1 and 2. The switch has at least two positions, designated as on and off. In the on position, the electrical heating circuit forms a closed electrical loop, and in the off position the electrical heating circuit is opened.

An opening or window (1*h* in FIG. 3*a*) may be provided such that the reservoir (2) is visible in second section (1*d*). Through the opening or window, a user may be able to determine how much product is left in the reservoir.

The bottom end (1*b*) of the reusable housing (1) has a removable cover (1*i*). The removable cover is attached to the reusable housing by any suitable means that holds the removable cover in place during normal operation of the dispenser, but which can be easily removed when desired. If the removable cover is removed from the reusable housing, then access is gained to the second section (1*d*). This allows the reservoir (2) and mechanical pump (3) to be put into or removed from the second section, as in initial factory assembly, or for replenishing the product (8) in the reservoir, or for supplying a new reservoir.

The overall dimensions of the reusable housing facilitate grasping the dispenser in one hand, while the actuator is actuated by a finger of the same hand. For example, the housing may be from 10 cm to 20 cm in length and from 2 cm to 5 cm in diameter, but these dimensions are merely exemplary. What is preferable is that the dispenser be handheld, i.e. it can be conveniently raised in the air and operated by one hand, such that the weight and dimensions of the dispenser are not an impediment to its use, as understood by a person of ordinary skill in the field of personal care devices. Personal care devices of the type herein disclosed, are expected to weigh no more than may be conveniently raised in the air, and operated with one hand. For example, when full, a dispenser may weigh less than about 1000 gms. Preferably, a full dispenser may weight less than 500 gms, and more preferably still, less than 250 gms. A lesser weight also facilitates portability, in general. Preferably, the dispenser can fit easily into a woman's purse or handbag. The size and weight of the dispenser make it conveniently portable and usable anywhere.

As noted above, the reusable housing (1) has an interior space that is divided into first and second sections (1*c*, 1*d*). First section (1*c*) is sufficiently large to accommodate the electrical heating circuit, while second section (1*d*) accommodates a reservoir (2) of product (8), and part of a dispensing mechanism. By separating the heating circuit from the dispensing mechanism, the heating circuit and dispensing mechanism do not have to be customized to work with each other. Therefore, if a design change is in order, the pump mechanism could be changed without affecting the heating circuit, for example. Or, for example, if the heating system is changed from a wire loop resistor to a printed circuit board as described herein, then the dispensing mechanism is not affected. This offers great flexibility, efficiency and potential savings in manufacture and assembly, that may not be available to many prior art devices.

The Reservoir

Referring to the exploded view shown in FIG. 2, the reservoir (2) holds a flowable product (8). The reservoir has an opened end (2*a*) through which it is filled with product. The reservoir fits into the second section (1*d*) of the reusable housing (1), preferably in a secure fit, so that the reservoir does not move excessively. The reservoir may be rigid or collapsible. If rigid, the reservoir may typically be glass or plastic. The reservoir and the second section may preferably be shaped complimentarily, so that the reservoir fits snugly, but removably, within the second section. For example, the reservoir and second section may typically and conveniently be a cylindrical, as shown. Alternatively, if the reservoir is collapsible, then the reservoir may be made from plastic, foil, paper, a combination of these, or some other material. The reservoir is topped by a dispensing system, preferably of a type commonly used in the cosmetic and personal care industries. A portion of the dispensing system is received into the opened end of the reservoir, while another portion of the dispensing system forms a liquid tight seal around the opened end of the reservoir. The dispensing system is seated to the reservoir by any suitable, liquid-tight means, such as snap fitments or screw threads.

The Dispensing System

The reservoir (2) is topped by a dispensing system or mechanism (3), preferably of a type commonly used in the cosmetic and personal care industries. In a preferred, but not exclusive embodiment, the dispensing mechanism is a metered dose mechanical pump. That is, a pump that upon user actuation provides a single, defined dose of product, after which the pump stops dosing product, and will not dose again until the pump is re-actuated by the user. The details of personal care, metered dose dispensers are well known, and the exact configuration of such may not limit the present invention. Broadly, there are lotion pumps and spray pumps. Lotion pumps are suitable for thicker, more viscous products such as lotions, creams, pastes, gels, oils, and suspensions. Spray pumps are suitable for thinner, less viscous liquids, such as aqueous and alcoholic solutions that do not have a lot of particulate matter suspended therein, and that can exit the pump at a speed that is sufficient to aerosolize the liquid when it strikes the atmosphere.

A first portion of the mechanical pump (3) is received into the opened end (2*a*) of the reservoir (2), while another portion of the mechanical pump forms a liquid tight seal around the opened end of the reservoir. The mechanical pump is seated to the reservoir by any suitable, liquid-tight means, such as snap fitments or screw threads. A second portion of the pump communicates with the an actuator (4). To that end, the pump has a stem (3*a*) which has an orifice (3*b*). In use, product rises through the stem and out the stem orifice. The stem communicates with the actuator (4) in a liquid tight fit. Typically, a pump stem is friction fit into an inlet opening (4*e*) in the actuator (see FIG. 4). Actuation of the pump is achieved by depressing the actuator, which causes the stem to move downward, which pressurizes product in a chamber of the pump, and opens a port through which the pressurized product may flow into the stem (3*a*), through the stem orifice (3*b*) and into the actuator. The distance that the stem may travel is called the stroke length of the pump.

Also potentially useful in the present invention are dispensing systems that dose continuously, as long as a valve is held opened, and the product is not depleted. An example of this is an aerosol system or pressure sleeve systems. Though these may not technically be mechanical pumps, they may be useful in the present invention. Nevertheless, the use of metered dose dispensers is preferred, as the dispensed product will be ore efficiently heated.

The Actuator-Heating Chamber Combination

Figure 4:
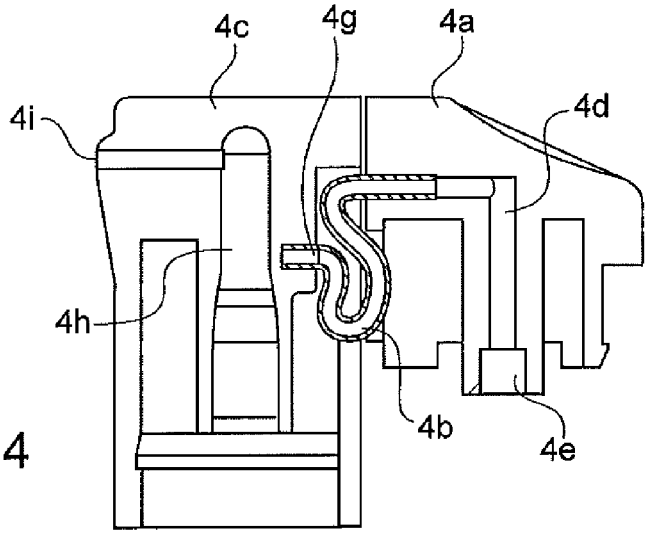
FIG. 4 is a cross sectional view of a combination actuator-heating chamber for use on the reusable heating dispenser of the present invention.
Figure 7:
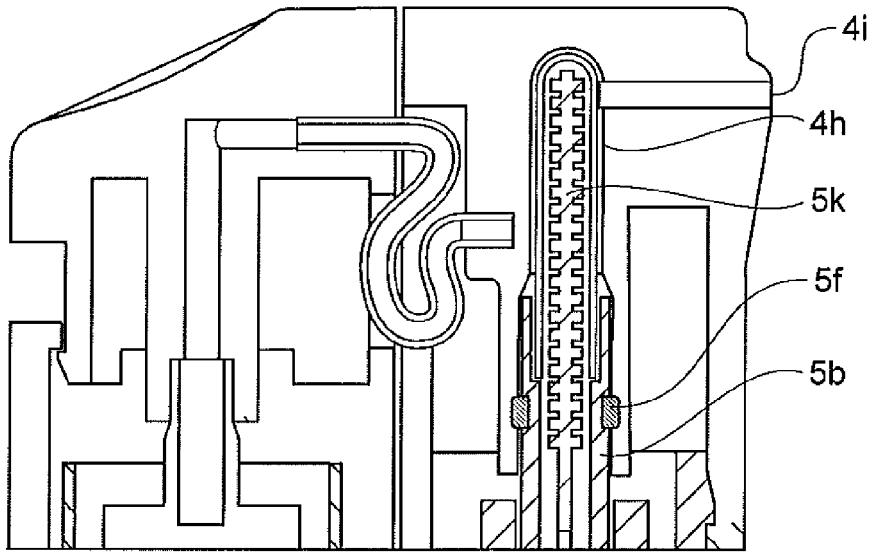
FIG. 7 is similar to FIG. 4, but shows a portion of the heating circuit sub-assembly in the heating chamber.

FIGS. 4 and 7 offer cross sectional views of a combination actuator-heating chamber (4) for use on the reusable heating dispenser of the present invention. The actuator-heating chamber combination is comprised of a pump actuator (4*a*), a flexible conduit (4*b*) and a dispensing head (4*c*).

The pump actuator is for actuating a mechanical pump (3). The pump actuator (4*a*) is located near the top end (1*a*) of the reusable housing (1), specifically over and/or associated with the second section (1*d*). Referring to FIGS. 2 and 4, the actuator has a channel (4*d*) that passes through it, extending from an actuator inlet (4*e*) of the actuator toward an exit orifice (4*f*) of the actuator. The channel is for conducting flowable product after it emerges from the pump. The pump actuator has liquid tight, fluid communication with the pump stem (3*a*). Typically, the pump stem is friction fit into the inlet opening (4*e*) of the actuator. Optionally, the actuator may be removable from the pump stem. Before the actuator is put into its assembled configuration, or when the actuator is otherwise not in its assembled configuration, the second section may be accessible from the top of the reusable housing.

The pump actuator is slidable up and down for a distance that corresponds to the stroke length of the mechanical pump. Actuation of the pump is achieved by depressing the actuator, which causes the stem to move downward, which pressurizes product in a chamber of the pump, and opens a port through which the pressurized product may flow into the pump stem, through the stem orifice (3*b*) and into the actuator. A product flow path is defined through the actuator. The path includes the actuator inlet (4*e*), the actuator channel (4*d*) and the actuator orifice (4*f*). Intermediate channels may be defined between these portions of the actuator flow path. The actuator orifice communicates in a liquid tight way with the dispensing head (4*c*), such that pressurized product emerging from the actuator orifice eventually enters the dispensing head.

The dispensing head (4*c*) is located near the top end (1*a*) of the reusable housing (1), specifically over and/or associated with the first section (1*c*). The dispensing head is attached to the reusable housing by any suitable means that holds the dispensing head in place during normal operation of the dispenser. Preferably, the dispensing head does not move during normal operation. Optionally, the dispensing head may be removable from the reusable housing. Before the dispensing head is put into its assembled configuration, or when the dispensing head is otherwise not in its assembled configuration, the first section may be accessible from the top of the reusable housing.

A product flow path is defined through the dispensing head (4*c*). The path includes dispensing head inlet (4*g*), leading to a heating chamber (4*h*), leading to a dispenser exit orifice (4*i*), from which heated product emerges to the exterior of the heating dispenser, for transfer to an application surface. Intermediate channels may be defined between these portions of the dispensing head flow path. The heating chamber (4*h*) is opened toward its lower end, which allows the printed circuit board housing (5*b*) to pass into the heating chamber, from the first section (1*c*) of the reusable housing (1). This opening is such that it can be made liquid tight, so that product flowing through the heating chamber does not flow into the first section of the reusable housing, but stays in the dispensing head flow path toward the exit orifice (4*i*).

Unlike the pump actuator (4*a*), the dispensing head (4*c*) is not intended to move relative to the dispenser. Preferably, the dispensing head does not move, relative to the dispenser, during normal operation. Therefore, when the actuator is moved up and down, the dispensing head does not move. In order to convey pressurized product from the moving actuator to the stationary dispensing head, a flexible conduit (4*b*) is provided. The conduit has a first end that is in fluid communication with the exit orifice (4*f*) of the actuator. This end of the conduit moves up and down with the actuator. The conduit has a second end that is in fluid communication with the inlet (4*g*) of the dispensing head. This end of the conduit is stationary. Either connection may be made by friction fitting an end of the conduit into the exit orifice of the actuator or the inlet of the dispensing head. Any other suitable means may be used.

In the personal care field, appearance can be as important or more important than function. Therefore, it is preferable if the actuator and dispensing head are immediately adjacent to one another, so as to form the appearance of a single component of uniform design (see FIGS. 1*b*, for example). Under these circumstances, in order for the flexible conduit to span between the actuator and dispensing head, it may be necessary to provide a space inside the actuator and/or dispensing head, where the flexible conduit can reside. In FIGS. 1*c* and 4, for example, a space (4*j*) has been provided for the flexible conduit below the top of the dispensing head.

The conduit is flexible to a necessary degree. A necessary degree includes allowing the actuator to travel up and down without restriction. On the other hand, the conduit is sufficiently strong so that as it flexes, the lumen inside the conduit is not significantly restricted, and product flow is not significantly hindered. Preferably, the conduit is a flexible plastic tube.

The flow path through the mechanical pump, the flow path through the actuator, the flexible conduit, and the flow path through the dispensing head define an overall flow path. Preferably, at each connection of components along the flow path, the connections are fluid tight. This not only prevents product from leaking out of the flow path, but also prevents the product form being exposed to the air, which may "dry out" the product.

The Switchable Electric Heating Circuit

Figure 5A:
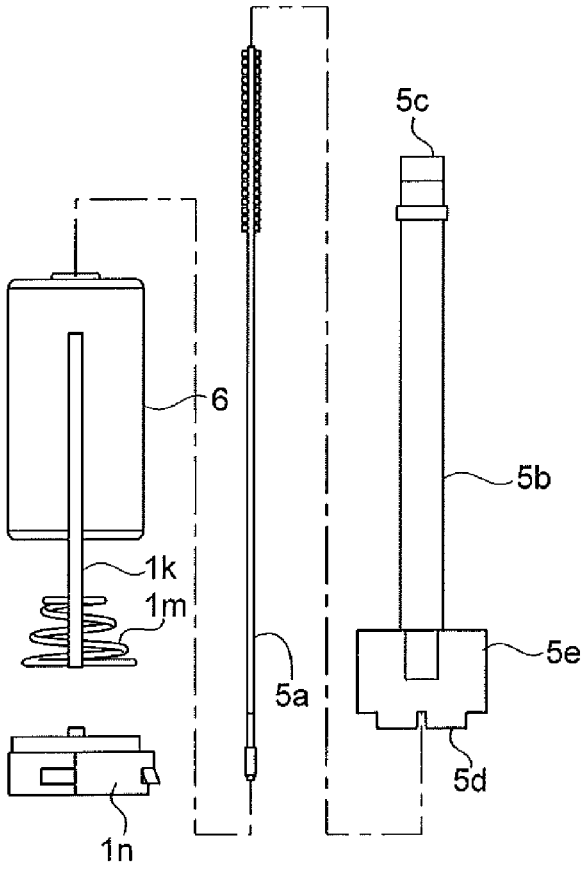
FIG. 5*a* is an exploded view of a switchable electric heating circuit.
Figure 5B:
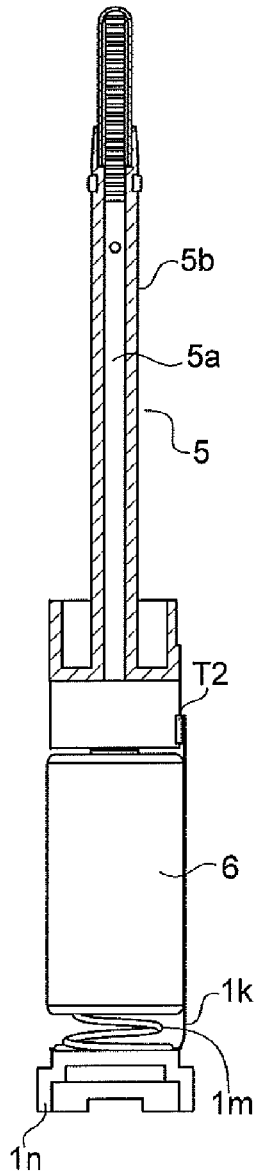
FIG. 5*b* is a cross sectional view of a switchable electric heating circuit.
Figure 6A:
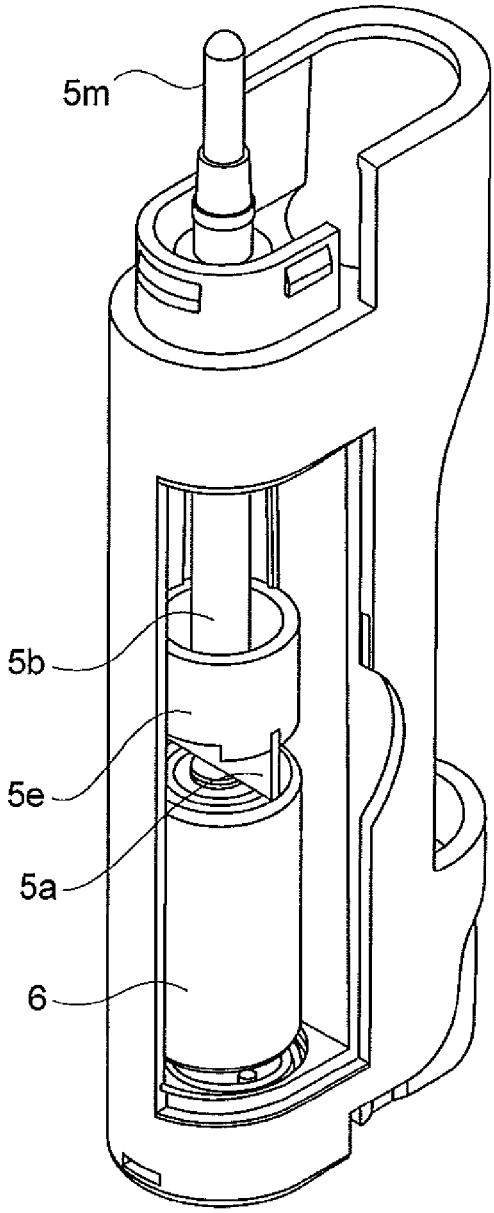
FIG. 6*a* is a perspective view of a dispenser according to the present invention, with the battery door opened, showing the situation of the heating circuit in the reusable housing.
Figure 6B:
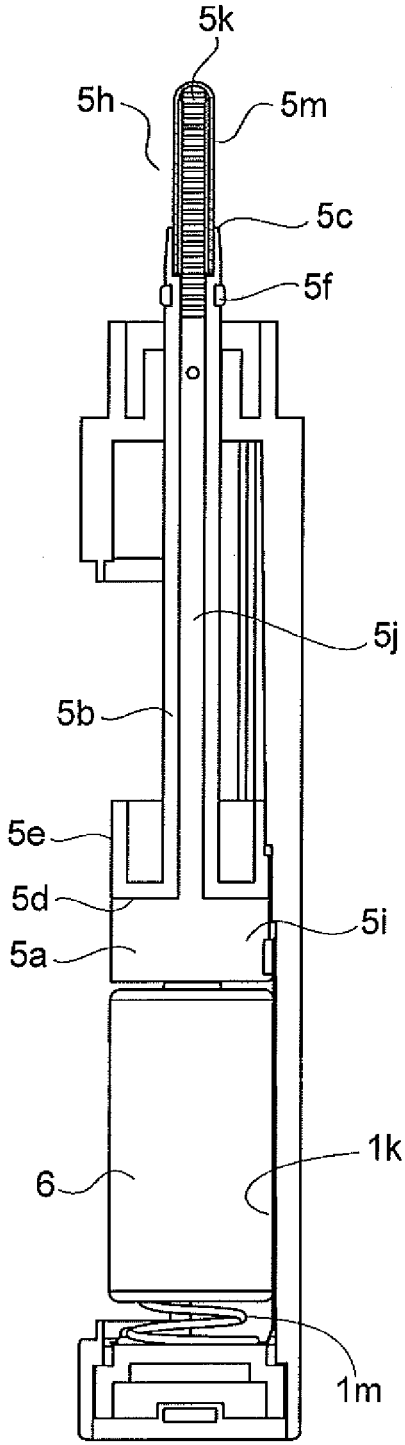
FIG. 6*b* is a cross section of the device in FIG. 6*a*.

The reusable dispenser further comprises an interruptible or switchable electric heating circuit. Referring to FIGS. 5*a* and 5*b*, the switchable electric heating circuit is comprised of a heating circuit sub-assembly (5) in combination with a power source (6), a means to operate an electrical switch (1*g*), and one or more electrical conductors that carry electricity between the power source and a printed circuit board (PCB, 5*a*) which is part of the heating circuit subassembly. This circuit may include other elements, as well. When the switch is closed, current flows to the heat generating portion, and this defines the heat generating portion as "on". When this switch is opened, current is not flowing to the heat generating portion, and this defines the heat generating portion as "off". The reusable dispenser may comprises additional circuits, as well.

The Heating Circuit Sub-Assembly

The heating circuit sub-assembly (5) comprises a printed circuit board (5*a*) and housing (5*b*) for the printed circuit board. One embodiment of a printed circuit board housing is shown in FIGS. 5*a*, 5*b*, 6*a* and 6*b*. The PCB housing is a hollow, elongated member that is opened at its upper end (5*c*) and lower end (5*d*) to permit the printed circuit board to be reposed through it, with portions of the printed circuit board emerging from both ends of the PCB housing. The PCB housing is situated inside first section (1*c*) of the reusable housing (1), such that the PCB housing does not move substantially in relation to the reusable housing. For example, a lower end (5*d*) of the PCB housing may be shaped complimentarily to the interior of the first section (1*c*) of the reusable housing. For example, in the figures, the lower end of the PCB housing has a cylindrical portion (5*e*) that fits snugly within the cylindrical interior of the reusable housing. Also, in the embodiment shown in the FIGS. 6*a* and 6*b*, the upper end of the PCB housing passes through, and is held firmly by, a first opening (see 1*j* in FIG. 3*b*) in the reusable housing. Any other means of securing the PCB housing against unwanted motion may be used.

Referring to FIG. 7, as discussed above, the heating chamber (4*h*) is opened toward its lower end, which allows the printed circuit board housing (5*b*) to pass into the heating chamber, from the first section (1*c*) of the reusable housing (1). This opening is such that it can be made liquid tight, so that product flowing through the heating chamber does not flow into the first section of the reusable housing, but stays on the product flow path toward the exit orifice (4*i*). For example, a gasket (5*f*) may be provided near the top of PCB housing, around the exterior of the PCB housing. The gasket forms a liquid tight seal against the interior walls of the heating chamber to prevent product from flowing into the first section of the reusable housing.

The printed circuit board (PCB) (5*a*) is an elongated structure that passes through the PCB housing (5*b*). A first potion of a printed circuit board is housed in the first section, extending from the electric current source (6), up toward the heating chamber (4*h*) of the dispensing head (4*c*). A second portion of the printed circuit board supports a heat generating portion (5*h*), inside a heating chamber. The bulk of the electronic circuitry is carried on a printed circuit board, including specifically, one or more heat generating portions, which are located in the heating chamber, but preferably not in the first section (1*c*). The printed circuit board comprises a substrate (5*g*) that is non-conductive to electricity under the conditions of normal or expected use. Suitable substrate materials include, but are not limited to, epoxy resin, glass epoxy, Bakelite (a thermosetting phenol formaldehyde resin), and fiberglass. The substrate may be about 0.25 to 5.0 mm thick, preferably 0.5 to 3 mm, more preferably, 0.75 to 1.5 mm thick. Portions of one or both sides of the substrate may be covered with a layer of copper, for example, about 35 μm thick. The substrate supports one or more heat generating portions, electronic components and conductive elements. Among the conductive elements supported by the PCB, are electrical leads and/or terminals that that are effective to connect the PCB to a battery (6).

Figure 8:
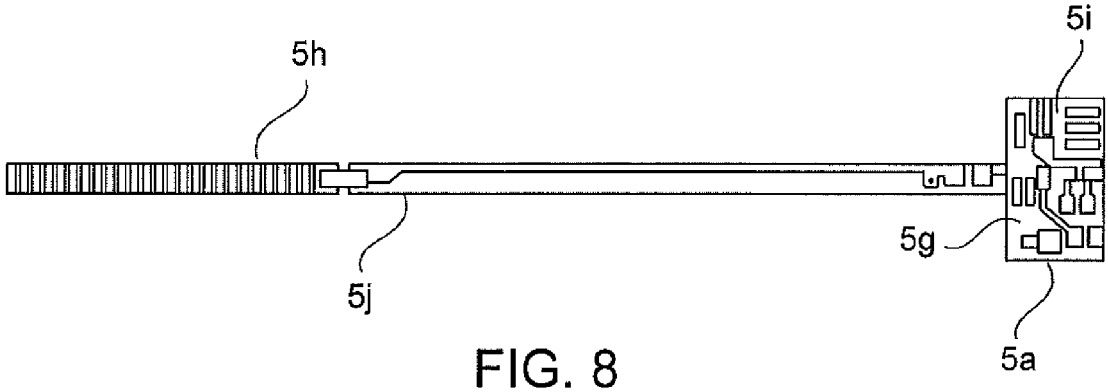
FIG. 8 is a representation of a printed circuit board with heat generating portion.
Figure 9:
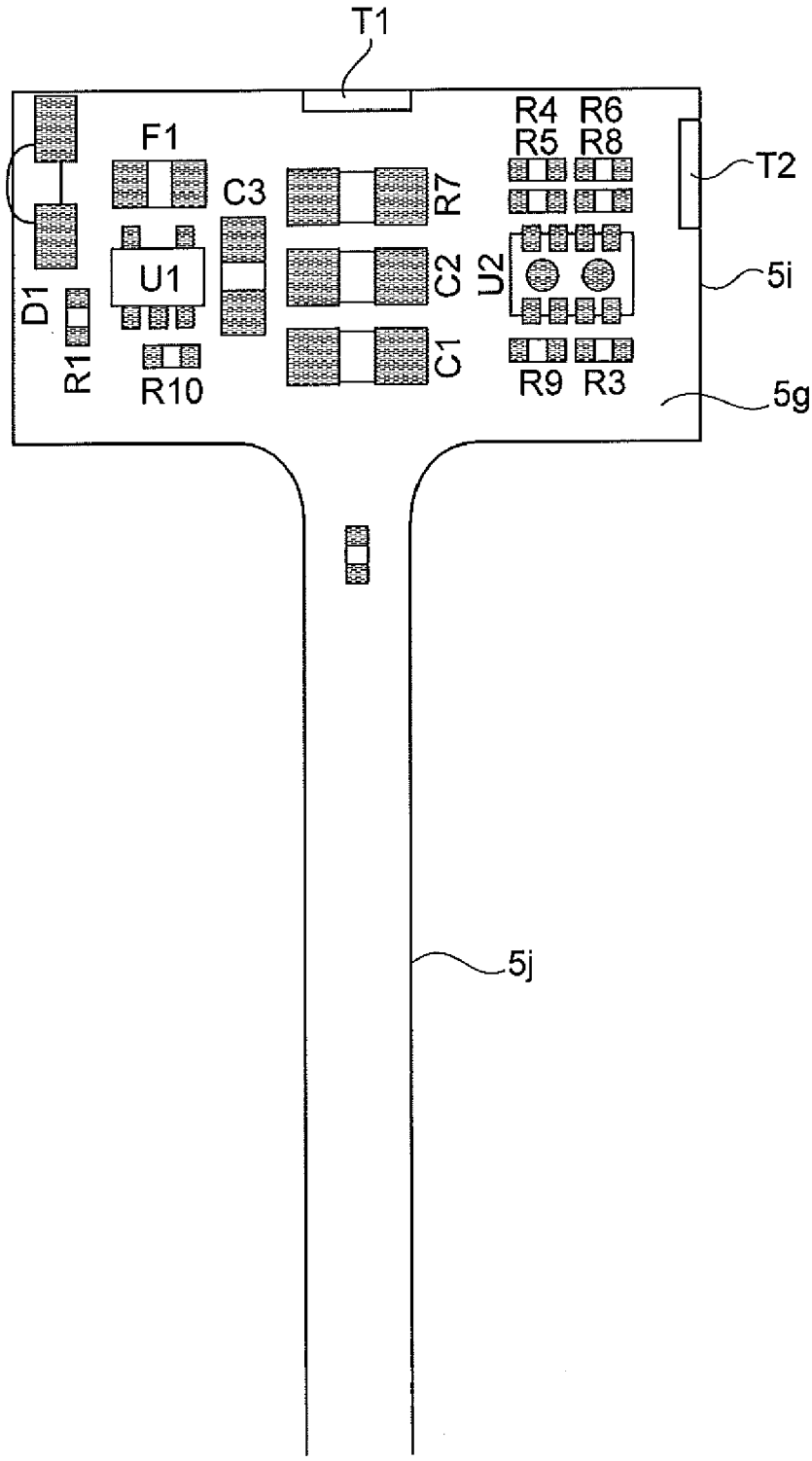
FIG. 9 shows one possible electronic circuit laid out on a printed circuit board.

As an example, a printed circuit board (5) will be described that supports various elements in a preferred (but not exclusive) arrangement. The PCB itself may have any shape or dimensions that are convenient to manufacture and assemble into the PCB housing (5*b*) and reusable housing (1), with the requirement that the PCB is able to extend from the electric current source (6), and into the heating chamber (4*h*). This length depends on the overall length and design of the dispenser, which has been discussed above. Referring to FIGS. 8 and 9, all or most of the electronic elements or components except the resistive heating element(s) (5*k*) may be located on an enlarged portion (5*i*) of the printed circuit board, near the lower end of the board. The largest lateral dimension of the enlarged portion of the PCB must be less than an interior dimension of that part of the first section (1*c*) in which it resides. A relatively narrow, elongated section (5*j*) of the PCB extends from the enlarged portion, through the PCB housing (5*b*), and emerges from the upper end (5*c*) of the PCB housing into the heating chamber (4*h*) of the dispensing head (4*c*). A portion of the PCB that is inside the heating chamber, holds the heat generating portion (5*h*).

Figure 10:
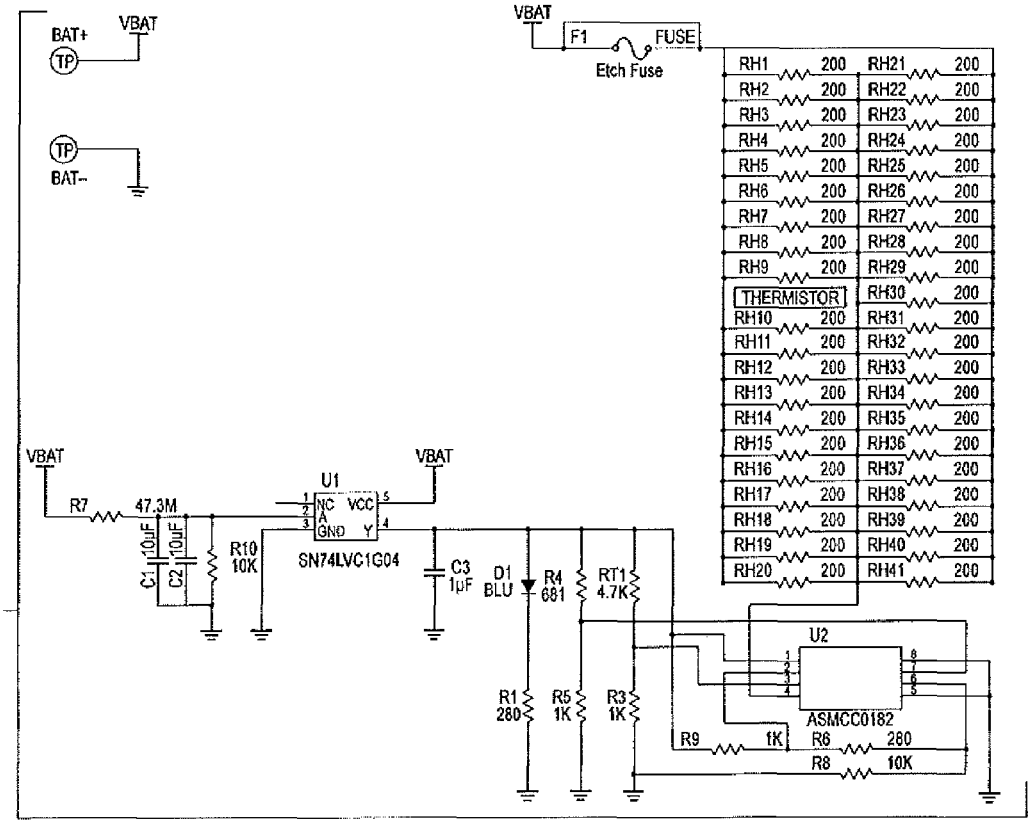
FIG. 10 is a schematic of one possible electronic circuit used in the present invention.

FIG. 10 shows one possible electronic circuit useful in the present invention, which could be laid out on a printed circuit board (5). FIG. 9 shows one possible layout of electronic elements on the PCB. Electric current from a power source (6), (a rechargeable battery, for example) enters the printed circuit board at a PCB terminal (T1). This terminal may occupy an edge of an enlarged portion (5*i*) of the PCB. In a preferred embodiment, the positive terminal of the battery (6) may alternately occupy at least one "on" position and at least one "off" position, according to the positioning of the switch (1*g*). That is, movement of the switch may physically move the battery. In an "on" position, the positive terminal of the battery directly contacts a terminal of the PCB. In the "off" position, the positive terminal of the battery has no contact with a terminal of the PCB. This embodiment has the advantage that it does not require additional conductors between the positive terminal of the battery and circuit board. Alternate embodiments for the functioning of switch (1*g*) are possible, according to the well known operation of switches.

Resistor R7 and parallel capacitors C1 and C2, interact with a power inverter U1, to automatically shut off current to the heat generating portion (5*h*) when the capacitors are full. The capacitors may be, for example, ceramic chip capacitors, fastened to or otherwise associated with the PCB. The rated capacitances are chosen to control the length of time from when the switchable circuit is first closed, to when the switchable circuit (and heat generating portion) will automatically turn off. This overhead timer, automatic shut off feature is optional, and prevents the battery from running down if the user fails to turn off the circuit. It also prevents product that remains in the heating chamber from being exposed to heat for too long a period of time. Should this occur, the product may become damaged. Therefore, the heat generating portion may turn off automatically about 120 seconds after the heat generating portion has reached a predetermined temperature; preferably about 60 seconds thereafter; and more preferably about 30 seconds thereafter. Furthermore, depending on the level of sophistication employed, an overhead timer such as the capacitor-based one shown in FIG. 10, may require a reset period, following an automatic shut off, in which the heating elements cannot be activated (i.e. cannot be "turned on"). The reset time, which may be several seconds, allows the capacitors to discharge.

RT1 is an NTC thermistor. Preferably, the NTC thermistor is physically located in close proximity to the heating elements (5*k*). For example, in the circuit diagram of FIG. 10, a space is shown between heating elements RH9 and RH10. The NTC thermistor may be located in that space, or any space where it could detect slight variations in the ambient temperature of the space surrounding the heating elements. The NTC thermistor and a fixed value resistor R3, are configured as a voltage divider circuit that creates a voltage level that is proportional to and/or varies with the temperature of the heating elements. That voltage level is monitored by an operational amplifier and is passed to the operational amplifier at the inverting input (pin 3 of U2). A threshold reference voltage is produced by another voltage divider circuit at R4 and R5, and this voltage is connected to the non-inverting input (pin 7 of U2) of the operational amplifier. In this way, the operational amplifier is used as a voltage comparator. When the output voltage of the voltage divider circuit that includes the negative temperature thermistor crosses the reference voltage (either rising above or falling below), then the output of the operational amplifier (pin 2 on U2) changes state. The output of the op amp is passed to an N-channel MOSFET switch (at pin 6 of U2), and is used to control the state of MOSFET switch. When the switch is closed, current flows from the switch (at pin 4 of U2) to the resistive heating elements (5*k*). When the switch is opened, current cannot flow to the resistive heating elements. An edge of the enlarged portion (5*i*) of the PCB (5) is provided with a second terminal (T2), which leads to the negative battery terminal through the metal strip (1*k*) and coil/spring (1*m*, see FIG. 5*b*).

The circuit may further include noise reducing components, such as capacitor C3, an on/off indicator, such as LED D1, and multiple fused portions, such as at F1. Also, more than one thermistor can be used to increase the temperature monitoring capabilities.

The circuit, as described, includes a system that actively measures the output temperature and adjusts itself to meet a desired temperature. A heating dispenser that includes this circuit can stay on indefinitely, holding a desired temperature, with no concern for overheating. Also, through the use of an automatic shut off and through the monitoring of the temperature of the heating elements, power utilization is significantly reduced. In this regard, the present invention may provide a commercially feasible reusable heating pump dispenser with a level of precision and reliability described herein.

The circuit may further include a system for monitoring and maintaining an output voltage of the power source. For example, batteries are rated with a nominal voltage, such 3 volts, but there is some variability from battery to battery, and from use to use of the same battery. An optional system may be included that monitors and adjusts as needed, the battery voltage, to maintain a tighter tolerance of voltage than the battery normally supplies. One benefit of such a system is improved consistency in applicator performance and improved predictability in battery lifetime.

The circuit described above utilizes a printed circuit board (5*a*) to form an electronic circuit subassembly, that can be inserted into the first section (1*c*) of the reusable housing (1). This electronic circuit subassembly is not dependent on the reusable housing for its structural integrity, nor for its electrical operation. The use of a printed circuit subassembly may result in a cost savings, and error reduction in manufacture. Thus, the circuit herein described may provide a truly effective, commercially feasible, aesthetically acceptable, battery powered, reusable heating dispenser, with the performance, reliability and convenience herein described, and may well achieve a cost savings and error reduction in manufacturing. In contrast, without a circuit board as herein described, the creation of an electronic circuit sub-assembly would be considerably more difficult, more expensive, and less reliable. For the personal care market, creating an electronic circuit subassembly without a printed circuit board as herein described, may make the cost of manufacture prohibitive, and the performance of lower quality.

Heat Generating Portion

One or more heat generating portions (5*h*) are supported by a second portion of the printed circuit board, nearer the upper end of the printed circuit board (5*a*), inside the heating chamber (4*h*). Typically, a dispenser according to the present invention may have only one heat generating portion. Preferably, no part of the heat generating portion extends into first section (1*c*), as heating the first section wastes energy and may raise the temperature of product (8) in the reservoir (2).

The heat generating portion may comprise a continuous resistive wire loop or coil. While straightforward, this type of heat generating portion does no offer the performance and energy efficiency of more advanced options, such as an array of discrete heating elements. Therefore, preferably, a heating dispenser according to the present invention includes a plurality of individual, discrete resistive heating elements (5*k*), located near the upper end of the printed circuit board (5*a*), inside the heating chamber (4*h*).

A preferred embodiment of the discrete resistive heating elements (5*k*) is a bank of fixed value resistors electronically arranged in series, parallel, or any combination thereof, and physically situated in two rows, one on either side of the PCB. The number of resistors and their rated resistance is governed, in part, by the requirements of heat generation of the circuit. In one embodiment, 41 discrete resistors of 5 ohms are uniformly spaced, 20 on one side of the PCB, and 21 on the other side. In another embodiment, 23 6-ohm resistors are used, 11 on one side of the PCB, 12 on the other. In still another working model, forty-one 3-ohm resistors are used, 20 on one side, 21 on the other. The side with 1 fewer resistor leaves a space for a thermistor. Typically, a heating dispenser according to the present invention might use individual resistive elements having rated resistances from 1 to 10 ohms. However, this range may be exceeded as the situation demands. Typically, the overall resistance of all the heating elements might range from 1 to 10 ohms. However, this range may be exceeded as the situation demands.

One preferred type of resistive heating element is a metal oxide thick film resistor. These are available in more than one form. One preferred form is a chip resistor, which is thick film resistor reposed on a solid ceramic substrate and provided with electrical contacts and protective coatings. Geometrically, each chip may be approximately a solid rectangle. Such heating elements are commercially available, in a range of sizes. For example, KOA Speer Electronics, Inc (Bradford, Pa.) offers general purpose thick film chip resistors, the largest dimension of which is on the order of 0.5 mm or less. By using resistors whose largest dimension is about 2.0 mm or less, better, in one embodiment 1.0 mm or less, even better, in another embodiment 0.5 m or less, the resistors can easily be arranged along the printed circuit board (5*a*), within the heating chamber (4*h*).

Typically, chip resistors may be attached to the PCB by known methods. A more preferred form of metal oxide thick film resistor, is available as a silk screened deposit. Without a housing, such as the chip resistor, the metal oxide film is deposited directly onto the printed circuit board, using printing techniques. This is more efficient and flexible from a manufacturing point of view than welding chip resistors. The metal oxide film may be deposited on the PCB as one continuous heating element, or it may be printed as individual dots. Various metal oxides may be used in thick film resistor manufacture. One preferred material is ruthenium oxide ($RuO_2$). The individual dots may be printed as small as about 2.0 mm or less, more preferably 1.0 mm or less, most preferably 0.5 mm or less, and their thickness may vary. In fact, by controlling the size of the dots, one may alter the resistance of each dot. Also, the resistance of the thick film resistor, whether in a chip resistor or silk screened form, may also be controlled by additives in the metal oxide film. Typically, chip resistors and silk screened metal oxide dots of the type described herein, may have a rated resistance of 1 to 10 ohms.

A printed circuit board that carries silk screened thick film resistors or chip resistors, is less bulky than one that carries prior art heating elements such as a wire coil. Less bulky electronics means that the flux of heat into the product is increased, and less heat is wasted.

Preferably, the heat generating portion further comprises a protective tip (5*m*) that covers the resistive heating elements (5*k*) near the upper end of the printed circuit board (5*a*). The protective tip prevents product from directly contacting the printed circuit board and heating elements, while also evenly distributing heat throughout the heating chamber (4*h*). Also, the protective tip must be able to fit into the heating chamber of the dispensing head (4*c*), while leaving sufficient volume in the heating chamber for a dose of product, which as discussed, may typically range from 50 μL to 500 μL. Preferably, the volume of the heating chamber that may be filled with product (hereinafter, the "usable volume") is approximately equal to the dose volume. If the usable volume of the heating chamber is significantly larger than the dose of product, then air may remain in the heating chamber, which would decrease the efficiency with which the product is heated. On the other hand, if the usable volume of the heating chamber is significantly smaller than the dose volume, then product dispensed from the dispenser may include some product that did not dwell inside the heating chamber, and therefore was not sufficiently heated. Preferably, the usable volume is within the range defined by: dose volume±20%; more preferably dose volume±10%, and most preferably dose volume±5%.

The protective tip must conduct heat from its inside to its outside, to a necessary degree, and the rate at which the protective tip conducts and dissipates heat should be high, in order to provide the consumer with a fast application. Therefore, a tip material having higher thermal conductivity should be preferred to a material with lower thermal conductivity. The thickness of the tip will also affect the rate at which heat is moved from the heating elements to the product. Generally, a thinner tip is more efficient than a thicker one. In one embodiment, the protective tip (5*m*) may be fashioned as a cylindrical sleeve, closed at its upper end and opened at its lower end to slide over the upper end of the printed circuit board. Such a protective tip preferably has means that prevent it from unintentionally coming off of the printed circuit board. To this end, the protective tip may cooperate with a portion of the PCB housing (5*b*). For example, these parts may form a friction fitment, a snap fitment or a threaded engagement. Alternatively, these parts may be more permanently attached, as by adhesive, welding, or integrally molding, for example. This protective tip may be formed, for example, from metal, plastic, or elastomer. Among plastics, polyethylene has one the higher thermal conductivity (about 0.4-0.5 W/m·K) than several others, and may be preferred among plastics. In comparison, the thermal conductivity of stainless steel is about 16 W/m·K. In contrast, it is preferred if the walls of the heating chamber (4*f*) have a relatively lower thermal conductivity, so the less heat is lost to the environment. Therefore, if forming the walls of the heating chamber from plastic, polyethylene may be less preferred, in this regard.

Preferably, the protective tip (5*m*) fits snugly over the heating elements (5*k*). Most preferably, this fit is sufficiently snug to prevent the protective tip from coming off the PCB in normal handling and use. Furthermore, a snug fit of the protective tip on the heating elements improves the efficiency of heat transfer through the protective tip, from the inside, going out, while gaps between the heating elements and the protective tip decrease heat transfer efficiency. Therefore, it is preferable if there are as few gaps as possible between the heating elements on the printed circuit board and the inner surface of protective tip. Thus, in one embodiment of the present invention, the heating elements (5*k*) on the printed circuit board (5*a*) are in direct contact with an inner surface of the protective tip (5*m*). This arrangement is effective, but still may leave air-filled gaps underneath the protective tip (5*m*), between the heating elements (5*k*), for example. The transfer of heat through the protective tip (5*m*) and into a product in the heating chamber (4*h*) may be diminished by these air-filled gaps. Thus, it is most preferable if there are no such gaps.

In another embodiment of the present invention, the protective tip is formed as a cylindrical shell. Making the shell includes embedding the heating elements in a continuous mass of a heat transfer material. The material may be applied by dipping the upper end of the PCB into heat transfer material that is in a softened state. When the material hardens, there may be substantially no air gaps contacting the heating elements. In at least some embodiments, as long as the heat transfer material improves the rate of heat transfer from the heating elements into the heating chamber, then this embodiment is preferred for many applications. The heat transfer material can form a semi-hardened or hardened cylindrical shell over the upper end of the PCB. The cylindrical shell must fit into the heating chamber. Examples of useful materials for the cylindrical shell of heat transfer material include one or more thermally conductive adhesives, one or more thermally conductive encapsulating epoxies or a combination of these. An example of a thermally conductive adhesive is Dow Corning® 1-4173 (treated aluminum oxide and dimethyl, methylhydrogen siloxane; thermal conductivity=1.9 W/m·K; shore hardness 92 A). An example of a thermally conductive encapsulating epoxy is 832-TC (a combination of alumina and a reaction product of epichlorohydrin and Biphenyl F; available from MG Chemicals, Burlington, Ontario; thermal conductivity=0.682 W/m·K; Shore hardness 82 D). For the protective tip, a higher thermal conductivity is preferred over a lower thermal conductivity.

Various parameters of the heating dispenser will affect the amount of heat required to raise the temperature of a product in the heating chamber and/or the amount of time required to do it. For example, in general the more product in the heating chamber, the more heat will be needed to raise the temperature of the product to a product application temperature, in a given amount of time. Also, for example, given a specific rate of heat generation, a thicker protective tip (5*m*) means more time will be needed to raise the temperature of the product in the heating chamber. To increase the rate of heat transfer through the protective tip, and to reduce the amount of heat lost, it may be preferable to make the protective tip as thin as possible, considering the limitations of manufacture in the specific material used. Preferably, the protective tip thickness is less than 1.0 mm, more preferably less than 0.8 mm, even more preferably less than 0.6 mm and most preferably less than 0.4 mm. Of course, since heat passes through the protective tip (5*m*), the amount of heat and/or the length of time needed to raise the temperature of a product disposed in the heating chamber also depends on the thermal conductivity of the material(s). So, in general, to decrease the amount of time required to raise the temperature of the product, one might increase the rate of heat generation, decrease the mass being in heated (smaller dose of product), and/or increase the thermal conductivity of the protective tip.

Heating circuits of the present invention are configured to raise the temperature of a dose of product from an ambient temperature to a product application temperature. That temperature may be adjusted to market demands. For example, the product application temperature may be 30° C. or greater, or 40° C. or greater, or 50° C. or greater, and so on, as the situation dictates. A handheld, reusable heating pump dispenser according to the present invention is able to heat an amount of a flowable product from an ambient temperature to a product application temperature, in 60 seconds or less, preferably 30 seconds or less, more preferably 15 seconds or less, and most preferably 5 seconds or less, immediately prior to dispensing. The amount of flowable product heated in this time is at least 50 μL, preferably at least 100 μL, more preferably at least 250 μL, most preferably at least 500 μL. As a result of heating, some characteristic of the dispensed product is enhanced or improved, while the characteristics of the product that remains in the dispenser have not been similarly altered. The improved characteristic may be for example a reduction in viscosity, activation of an active ingredient, a longer shelf life, a feeling of warmth experienced by the consumer, enhanced penetration of the product into the skin of a user, release of an encapsulated ingredient, or any other change that benefits the user. The The Power Source Preferred embodiments of the present invention further comprise a source (6) of electric current, preferably a DC power supply. The current source is housed within the first section (1*c*) of the reusable housing (1), which is sufficiently large to accommodate the current source. The current source has at least one positive terminal and at least one negative terminal, the terminals forming part of an afferent path (going away from the current source) and efferent path (going toward the current source), respectively. One or more of the power source terminals may directly contact a conductive element on the printed circuit board (5*a*), or one or more electrical leads may intervene, like lead (1*k*) or spring (1*m*).

In a dispenser of the present invention, each time the heating circuit is activated (or "turned on"), it is preferable if the power source (6) is able to provide, by itself, sufficient energy to raise the temperature of a product, as described herein. Preferably, the power source is able to last, without recharging or replacing, and without a substantial decline in heating performance, during the lifetime of a typical full size, (i.e. non-promotional size) commercial container. "Lifetime" of a container refers to the time that it takes for a user to extract and apply as much product from the container as possible, in normal, intended use.

In a preferred embodiment, the DC power supply includes one or more batteries (6), more preferably exactly one battery. Many types of battery may be used, as long as the battery can deliver the requisite power, over the lifetime of the package, to achieve defined performance levels. Examples of battery types include: zinc-carbon (or standard carbon), alkaline, lithium, nickel-cadmium (rechargeable), nickel-metal hydride (rechargeable), lithium-ion, zinc-air, zinc-mercury oxide and silver-zinc chemistries. Common household batteries, such as those used in flashlights and smoke detectors, are frequently found in small handheld devices. These typically include what are known as AA, AAA, C, D and 9 volt batteries. Other batteries that may be appropriate are those commonly found in hearing aides and wrist watches. Furthermore, it is preferable if the battery is disposable in the ordinary household waste stream. Therefore, batteries which, by law, must be separated from the normal household waste stream for disposal (such as batteries containing mercury) are less preferred. In one noteworthy embodiment, the power performance needs of the heated dispenser of the present invention may be met by a single, non-rechargeable battery, based on a lithium/manganese dioxide chemistry (having no mercury), that provides a nominal 3 volts and that has a capacity of at least 1,400 mAmp-hours, for example, 1,400-1,800 mAmp-hours. "Nominal 3 volts" includes 2.5-3.5 volts. One such commercially available battery is the Energizer® 123 (nominal 3 v, 1,500 mAmp-hours).

Optionally, the power source may be replaceable or rechargeable. For example, the reusable housing (1) may have a removable door (1*f*). The removable door offers access to the battery (6) in the first section (1*c*). Alternatively, or in addition to being replaceable, the battery may be of the rechargeable type. To that end, either the battery can be removed from the reusable housing, as just described, or the exterior of the reusable housing can be provided with electric leads to the battery, such that the dispensing device can be reposed in a charging base, so that power from the base is transmitted to and stored in the battery. While these optional features are disclosed herein, their implementation may depend on various factors. For example, depending on the part of the world in which the applicator is being sold and used, disposal of batteries is governed by regulation. In particular, the sale, use and disposal of rechargeable batteries may be subject to more demanding restrictions than non-rechargeable batteries. For these reasons, for other environmental concerns, and for consumer convenience, preferred implementations of the heating dispenser herein disclosed, include a single power source that is sufficient, in normal use, to provide power for heating product, until no more product can be dispensed.

The On/Off Switch

A dispenser according to the present invention may comprise one or more electrical switches. Generally, at least one electrical switch is an on/off switch that is capable of alternately interrupting and re-establishing the flow of electricity between the power source and the heating elements.

In one possible embodiment, at least one of the on/off switches includes one or more switches accessible from the outside the dispenser that can be engaged, either directly or indirectly, by a finger of the user. This type of on-off switch is "manual", requiring the user to directly engage the switch, which is something that a user does not have to do with a conventional, non-heating dispenser. The details of such switches are well known in the electrical arts and there are many suitable types. Some non-limiting examples include: toggle switches, rocker switches, sliders, buttons, rotating knobs, touch activation surfaces, magnetic switches and light activated switches. Also, multi-position switches or slider switches may be useful, if the heating elements are capable of multiple heating output levels. In general, a manual switch may be located anywhere that makes it accessible (directly or indirectly) from the outside the dispenser.

In the embodiment of FIGS. 1*a*, 1*b* and 2, a sliding switch is located on an exterior wall of the battery door (1*f*). In this case, the metal spring (1*m*) serves a dual purpose. A first purpose of the metal spring, as noted earlier, is to serve as an electrical lead to the negative terminal of the battery (6). A second purpose, is to urge the battery from a first position to a second position. In the first position, when the spring is more compressed against the spring support (1*n*), the battery's positive terminal is not making electrical contact with the printed circuit board (5). In this arrangement, current cannot flow to the heating elements (5*k*). In the second position, when the spring is more expanded, the battery's positive terminal is making electrical contact with the printed circuit board, in a way that allows current to flow to the heating elements. In a preferred embodiment, the enlarged portion (5*i*) of the printed circuit board comprises an electric lead (T1, in FIG. 9) that is able to contact a positive terminal of the battery (6), when the battery is in its second position. For example, the electrical lead (T1) is near a proximal edge of the enlarged portion, where a positive terminal of the battery may contact it.

Also, in this embodiment, the switch (1*g*) comprises one or more extensions (1*o*) that pass from the outside to the inside of the reusable housing (1), where they are able to contact the battery (6). When the switch slides down, the extensions push the battery downward, toward first position, which is the off position, in this example. When the switch slides upward, the extensions slide upward, allowing the battery to move upward under the action of the spring (1*m*). When the battery reaches its second position, the battery's positive terminal makes electrical contact with the printed circuit board (5), such that current flows to the heating elements. This is the on position, in this example.

Products for Use with a Heating Pump Dispenser

A non-exhaustive list of product types that ma benefit from being used in a dispenser according to the present invention includes: products heated strictly for aesthetic reasons (i.e. shave cream); those heated to activate an ingredient; those heated to alter the rheology of the product; those heated to sterilize the product; those heated to release an encapsulated ingredient, as by melting a gelatin capsule, for example. Forms of product include creams, lotions, serums, gels, liquids, pastes, or any product that may be dispensed from a mechanical pump of the types known to used in the cosmetic and personal care fields. As described herein, the reservoir (2)

of the reusable heating dispenser is designed hold a finished product. That is, one that could be used even without heating or one that requires only heating to use. Therefore, products that require additional preparation beyond heating, are not suitable for the present invention. For example, a pre-shave foam mixture that must be combined with a liquid propellant outside of the reservoir (2), would not be suitable for use in the present invention. In general, the products may be mixtures, suspensions, emulsions, dispersions or colloids. Particularly preferred products are those that could be exploited by having some structural or dynamic property temporarily altered by heating. For example, heating may temporarily disrupt a magnetic field that arises out of the product, whereas, after cooling, the magnetic field may be reestablished.

In general, as a material is heated, the change in temperature varies inversely with the heat capacity of the material. Therefore, considering the time and energy required to heat product contained in the heating chamber (4*h*), products having a smaller heat capacity may be thought of as more efficient than products having a larger heat capacity. Among cosmetic liquids, water has one of the higher heat capacities. Therefore, in general a personal care composition with less water may heat more efficiently than one with more water, all else being the same. For some applications then, it may be preferable to use a product that has less than 50% water, more preferably less than 25% water, and more preferably still less than 10% water and most preferably, an anhydrous product. Of course, not every type of product can be implements as an anhydrous or low water product, and personal care compositions having 50% or more of water may still be suitable for use in a dispenser according to the present invention. A product application temperature can be achieved within a timeframe herein described.

Some of Various Optional Features

In one alternative embodiment, the heating elements are automatically switched on and off (i.e. activated and deactivated). "Automatically switched" means that the heating elements are turned on or off as a result of normal use of the dispenser. For example, when the actuator (4*a*) is depressed, the heating elements (5*k*) may be activated, and then deactivated when the actuator is released. Additional conductors between the actuator and the PCB would be required, but from a user point of view, there is no chance that a user will leave the heating elements on while the dispenser is not in use. This will preserve the product for the life of the package. In another embodiment, there may be more than one on-off switch in a single heating dispenser. A first switch could be a manual switch, such as described above, and a second switch could be an automatic switch. These could be wired to operate as a so-called "three-way" switch, giving the user the option of over-riding the automatic switch.

As noted above, the present invention is configured to raise the temperature of a dose of product from an ambient temperature to a product application temperature in a defined amount of time. Since the consumer may have to wait for heating to occur, the dispenser may be provided with an indication that the product has reached application temperature, and dispensing can begin. For example, a portion of the exterior surface of the dispenser may be fashioned from a material that reacts to changes in temperature, i.e. by changing color. In this case, the "thermochromic" surface should be sufficiently close to the heating chamber so that a visible color change occurs within a several seconds of the product in the chamber reaching application temperature; i.e. no more than 10 seconds, preferably, no more than 5 seconds, more preferably no more than 3 seconds.

A Reusable Pump Dispenser For Heated Personal Care Compositions as described herein, may be provided in consumer packaging that includes one or more reservoirs (2) filled with product. The product in any one reservoir may or may not be the same as the product contained in any other reservoir. The consumer packaging may include one or more batteries intended to power the heating elements of the heating dispenser.

A Reusable Pump Dispenser For Heated Personal Care Compositions as described herein, may be provided in consumer packaging that includes instructions for use of the dispenser, or that directs a user to instructions for use. For example, instructions for use may be printed on a substrate that is included with the consumer packaging that includes the dispenser. Alternatively, the packaging may direct the user to a website where instructions for use can be viewed on a monitor. Instructions for use may include some or all of the following: how to turn on the heating elements, how long to wait for product to heat before dispensing, how to dispense heated product, how to turn off the heating elements, how to access and change the battery (6), how to access and change the reservoir (2), how to dispose of any part of the heating dispenser.

Methods of Use

Methods of using a Reusable Pump Dispenser For Heated Personal Care Compositions as described herein, may include the following steps. A reusable heating pump dispenser containing a personal care product, according to the present invention is provided. A user grasps the reusable pump dispenser in her hand, and raises the dispenser in the air. The user engages a switch, and causes electrical power to flow between a current source and heating elements. The user waits a period of time while a portion of product in the dispenser is heated from an ambient temperature to a product application temperature. The user engages a pump actuator, and causes heated product to dispense from the heating dispenser. The user may or may not repeat the steps of waiting and/or engaging the actuator. The user engages a switch, and causes electric power to stop flowing to the heating elements. The user lowers the dispenser and releases her grasp on the dispenser. The step of waiting a period of time may include the user waiting at least as long as directed by someone or something other than the user. In the steps above, the waiting period may be less than 15 seconds, less preferably at least 15 seconds, even less preferably at least 30 seconds, and least preferably at least 60 seconds. Alternatively, the user may wait until a thermochromic material has visibly changed color. Some or all of the above steps may be performed at least once per week; for example, at least five times per week; for example, at least once per day; for example, at least twice per day; for example, at least three times per day. A user may perform the steps of opening the battery door (1*f*), removing a battery, replacing a battery, and closing the battery door. A user may perform the steps of opening the removable cover (1*i*) of the reusable housing (1), removing a reservoir (2) and/or inserting a reservoir into the second section (1*d*), and replacing the removable cover.

What we claim is:

1. A handheld heating pump dispenser comprising a reusable housing, a printed circuit board having a heat generating portion, a heating chamber having an exit orifice, a reservoir that is able to hold a flowable product, a dispensing system, an actuator, a flexible conduit, and a product flow path from the reservoir to the exit orifice, wherein:

the reusable housing is interiorly divided into a first section and a second section;

a first potion of the printed circuit board is housed in the first section, and is able to form electrical contact with a power source;

a second portion of the printed circuit board supports the heat generating portion inside the heating chamber;

the reservoir is housed in the second section;

a first portion of the dispensing system is disposed in the reservoir;

a second portion of the dispensing system communicates with the actuator in a liquid tight fit;

the product flow path comprises (in order) the reservoir, the dispensing system, the actuator, the flexible conduit, the heating chamber, and the heating chamber exit orifice; and wherein product is urged along the flow path as a result of depressing the actuator.

2. The dispenser of claim 1 further comprising an electrical switch that has at least two positions, in at least one of the positions the switch effects electrical contact between the heat generating portion and the power source, and in at least one of the positions the switch interrupts electrical contact between the heat generating portion and the power source, wherein the switch is accessible from the outside the dispenser, and can be engaged, either directly or indirectly, by a finger of a user.

3. The dispenser of claim 1 wherein the reusable housing has a removable cover that provides access to the second section of the reusable housing, the access allowing the reservoir and dispensing system to be removed from the reusable housing and a new reservoir and dispensing system to be put into the reusable housing.

4. The dispenser of claim 1 wherein the dispensing system is a metered dose mechanical pump that is able to dispense 50-500 μL of product in a single dose.

5. The dispenser of claim 4 wherein the actuator includes a product flow path comprising an actuator inlet, an actuator channel, and an actuator exit orifice, and wherein the dispenser further comprises:

a stationary dispensing head that has a product flow path comprising a dispensing head inlet, the heating chamber, and the heating chamber exit orifice;

and wherein the flexible conduit has a first end that is in fluid communication with the actuator exit orifice, and a second end that is in fluid communication with the dispensing head inlet.

6. The dispenser of claim 2 wherein the heat generating portion comprises a plurality of discrete, fixed value resistive heating elements.

7. The applicator of claim 6 wherein the printed circuit board comprises a substrate that is non-conductive to electricity, and that supports electronic components and electrical leads that are effective to connect the heat generating portion to the power source.

8. The dispenser of claim 7 further comprising an elongated printed circuit board housing that has the printed circuit board reposed through it, with portions of the printed circuit board emerging from both ends of the printed circuit board housing.

9. The dispenser of claim 7 that automatically turns off the heat generating portion about 30 seconds after the heat generating portion has reached a predetermined temperature.

10. The dispenser of claim 9 which includes a voltage divider circuit and a thermistor.

11. The dispenser of claim 10 which further comprises an operational amplifier and an N-channel MOSFET switch.

12. The dispenser of claim 6 wherein the heating elements are a bank of fixed value resistors electronically arranged in series, parallel, or any combination thereof, and physically situated in two rows, one on both sides of the printed circuit board.

13. The dispenser of claim 12 wherein the fixed value resistors have rated resistances from 1 to 10 ohms.

14. The dispenser of claim 13 wherein the overall resistance of all the heating elements ranges from 1 to 10 ohms.

15. The dispenser of claim 12 wherein the resistive heating elements are metal oxide thick film, chip resistors, the largest dimension of which is 2.0 mm or less.

16. The dispenser of claim 12 wherein the resistive heating elements are discrete dots of a metal oxide thick film, provided as a silk screen deposit on the printed circuit board.

17. The dispenser of claim 16 wherein the metal oxide thick film is comprised of ruthenium oxide ($RuO_2$), and each dot is 2.0 mm or less.

18. The dispenser of claim 6 wherein the heat generating portion further comprises a protective tip that covers the resistive heating elements.

19. The dispenser of claim 18 wherein the resistive heating elements are embedded in a continuous, solid mass of a heat transfer material.

20. The dispenser of claim 19 wherein the heat transfer material is one or more thermally conductive adhesives, one or more thermally conductive encapsulating epoxies or a combination of these.

21. The dispenser of claim 2 further comprising a battery that has a terminal, and the terminal may alternately occupy at least one "on" position and at least one "off" position, according to the positioning of the switch.

22. The dispenser of claim 21 wherein the terminal directly contacts a conductive element on the printed circuit board, when the terminal is on the "on" position.

23. The dispenser of claim 21 wherein the battery is a 2.5 to 3.5 volt battery, having a capacity of 1,400 mAmp-hours or more.

24. The dispenser of claim 23 wherein the battery is based on lithium/manganese dioxide chemistry and having no mercury.

25. The dispenser of claim 21, wherein the battery is rechargeable.

26. The dispenser of claim 21, wherein the battery is replaceable through a door in the reusable housing.

27. The dispenser of claim 1 wherein a portion of the exterior surface of the dispenser is fashioned from a thermochromic material, such that the thermochromic material changes color within 10 seconds of the product in the chamber reaching a product application temperature.

28. The dispenser of claim 1 wherein the reservoir holds a flowable product comprising less than 50% water.

29. The dispenser of claim 1 wherein the reservoir holds a flowable product that has a magnetic field.

30. A consumer package that includes a set comprising:

a handheld heating pump dispenser according to claim 1, wherein the reservoir in the second section contains a first flowable product;

one or more additional reservoirs containing a product that may or may not be the same as the product contained in any other reservoir;

one or more batteries intended to power the heating elements of the heating pump dispenser; and instructions for use of the dispenser.

31. A method of using a handheld heating pump dispenser comprising the steps of:

providing a reusable heating pump dispenser according to claim 21, containing a personal care product;

grasping the pump dispenser with one hand;

raising the dispenser in the air;

engaging the switch to cause electrical power to flow between the battery and heat generating portion;

waiting less than 15 seconds;

depressing the actuator to cause heated product to dispense from the heating dispenser.

* * * * *